US006459349B1

(12) United States Patent
Giday et al.

(10) Patent No.: US 6,459,349 B1
(45) Date of Patent: Oct. 1, 2002

(54) CIRCUIT BREAKER COMPRISING A CURRENT TRANSFORMER WITH A PARTIAL AIR GAP

(75) Inventors: Zoltan Giday, Neumuenster (DE); Alan J. Messerli, Bristol, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/519,222

(22) Filed: Mar. 6, 2000

(51) Int. Cl.[7] ..... H01F 17/06
(52) U.S. Cl. ..... 336/178; 336/175; 335/18
(58) Field of Search ..... 335/18; 361/42–51; 336/212, 175, 234, 178

(56) References Cited

U.S. PATENT DOCUMENTS

| | | | | |
|---|---|---|---|---|
| 2,340,682 A | | 2/1944 | Powell | |
| 2,719,203 A | | 9/1955 | Gelzheiser et al. | |
| 2,937,254 A | | 5/1960 | Ericson | |
| 3,158,717 A | | 11/1964 | Jencks et al. | |
| 3,162,739 A | | 12/1964 | Klein et al. | |
| 3,197,582 A | | 7/1965 | Norden | |
| 3,307,002 A | | 2/1967 | Cooper | |
| 3,517,356 A | | 6/1970 | Hanafusa | |
| 3,631,369 A | | 12/1971 | Menocal | |
| 3,803,455 A | | 4/1974 | Willard | |
| 3,883,781 A | | 5/1975 | Cotton | |
| 4,021,729 A | * | 5/1977 | Hudson, Jr. | 361/45 |
| 4,129,762 A | | 12/1978 | Bruchet | |
| 4,144,513 A | | 3/1979 | Shafer et al. | |
| 4,158,119 A | | 6/1979 | Krakik | |
| 4,165,453 A | | 8/1979 | Hennemann | |
| 4,166,988 A | | 9/1979 | Ciarcia et al. | |
| 4,220,934 A | | 9/1980 | Wafer et al. | |
| 4,255,732 A | | 3/1981 | Wafer et al. | |
| 4,259,651 A | | 3/1981 | Yamat | |
| 4,263,492 A | | 4/1981 | Maier et al. | |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |

(List continued on next page.)

*Primary Examiner*—Lincoln Donovan
*Assistant Examiner*—Tuyen Nguyen
(74) *Attorney, Agent, or Firm*—Cantor Colburn LLP

(57) ABSTRACT

A circuit breaker assembly having an electronic trip unit used to detect an overcurrent condition in a protected electrical circuit. The electronic trip unit being electrically connected to a current transformer used to sense electrical current and provide operating power to the electronic trip unit. The current transformer comprising a metal core having a top surface and a bottom surface where the difference between the top and bottom surfaces defines a height of the core. The core having a concentrical opening extending through the height so that the distance between an outside point on the concentrical opening and the closest outside point of the core defines a thickness of the core at that point. Passing through the core opening is a primary winding and encircling the thickness of the core is a secondary winding. To optimize usage of the current transformer, a partial air gap is added to the metal core so that the range of operation is maximized while at the same time minimizing the remanence attenuation.

7 Claims, 5 Drawing Sheets

U.S. PATENT DOCUMENTS 4,276,527 A 6/1981 Gerbert-Gaillard et al.
4,297,663 A 10/1981 Seymour et al.
4,301,342 A 11/1981 Castonguay et al.
4,360,852 A 11/1982 Gilmore
4,368,444 A 1/1983 Preuss et al.
4,375,021 A 2/1983 Pardini et al.
4,375,022 A 2/1983 Daussin et al.
4,376,270 A 3/1983 Staffen
4,383,146 A 5/1983 Bur
4,392,036 A 7/1983 Troebel et al.
4,393,283 A 7/1983 Masuda
4,401,872 A 8/1983 Boichot-Castagne et al.
4,409,573 A 10/1983 DiMarco et al.
4,435,690 A 3/1984 Link et al.
4,467,297 A 8/1984 Boichot-Castagne et al.
4,468,645 A 8/1984 Gerbert-Gaillard et al.
4,470,027 A 9/1984 Link et al.
4,479,143 A 10/1984 Watanabe et al.
4,488,133 A 12/1984 McClellan et al.
4,492,941 A 1/1985 Nagel
4,541,032 A 9/1985 Schwab
4,546,244 A 10/1985 Mostosi
4,550,360 A 10/1985 Dougherty
4,562,419 A 12/1985 Preuss et al.
4,589,052 A 5/1986 Dougherty
4,595,812 A 6/1986 Tamaru et al.
4,611,187 A 9/1986 Banfi
4,612,430 A 9/1986 Sloan et al.
4,616,198 A 10/1986 Pardini
4,622,444 A 11/1986 Kandatsu et al.
4,631,625 A 12/1986 Alexander et al.
4,642,431 A 2/1987 Tedesco et al.
4,644,438 A 2/1987 Puccinelli et al.
4,649,247 A 3/1987 Preuss et al.
4,658,322 A 4/1987 Rivera
4,672,501 A 6/1987 Bilac et al.
4,675,481 A 6/1987 Markowski et al.
4,682,101 A 7/1987 Cattaneo ..... 324/117
4,682,264 A 7/1987 Demeyer
4,689,712 A 8/1987 Demeyer
4,694,373 A 9/1987 Demeyer
4,710,845 A 12/1987 Demeyer
4,717,985 A 1/1988 Demeyer
4,733,211 A 3/1988 Castonguay et al.
4,733,321 A 3/1988 Lindeperg
4,764,650 A 8/1988 Bur et al.
4,768,007 A 8/1988 Mertz et al.
4,780,786 A 10/1988 Weynachter et al.
4,831,221 A 5/1989 Yu et al.
4,870,531 A 9/1989 Danek
4,883,931 A 11/1989 Batteux et al.
4,884,047 A 11/1989 Baginski et al.
4,884,164 A 11/1989 Dziura et al.
4,900,882 A 2/1990 Bernard et al.
4,910,485 A 3/1990 Bolongeat-Mobleu et al.
4,914,541 A 4/1990 Tripodi et al.
4,916,420 A 4/1990 Bartolo et al.
4,916,421 A 4/1990 Pardini et al.
4,926,282 A 5/1990 McGhie
4,935,590 A 6/1990 Malkin et al.
4,937,706 A 6/1990 Schueller et al.
4,939,492 A 7/1990 Raso et al.
4,943,691 A 7/1990 Mertz et al.
4,943,888 A 7/1990 Jacob et al.
4,950,855 A 8/1990 Bolonegeat-Mobleu et al.
4,951,019 A 8/1990 Gula
4,952,897 A 8/1990 Barnel et al.
4,958,135 A 9/1990 Baginski et al.
4,965,543 A 10/1990 Batteux
4,969,078 A * 11/1990 Yamamoto et al. ..... 336/182
4,983,788 A 1/1991 Pardini
5,001,313 A 3/1991 Leclerq et al.
5,004,878 A 4/1991 Seymour et al.
5,029,301 A 7/1991 Nebon et al.
5,030,804 A 7/1991 Abri
5,057,655 A 10/1991 Kersusan et al.
5,077,627 A 12/1991 Fraisse
5,083,081 A 1/1992 Barrault et al.
5,095,183 A 3/1992 Raphard et al.
5,103,198 A 4/1992 Morel et al.
5,115,371 A 5/1992 Tripodi
5,120,921 A 6/1992 DiMarco et al.
5,132,865 A 7/1992 Mertz et al.
5,138,121 A 8/1992 Streich et al.
5,140,115 A 8/1992 Morris
5,153,802 A 10/1992 Mertz et al.
5,155,315 A 10/1992 Malkin et al.
5,166,483 A 11/1992 Kersusan et al.
5,172,087 A 12/1992 Castonguay et al.
5,178,504 A 1/1993 Falchi
5,184,717 A 2/1993 Chou et al.
5,187,339 A 2/1993 Lissandrin
5,198,956 A 3/1993 Dvorak
5,200,724 A 4/1993 Gula et al.
5,210,385 A 5/1993 Morel et al.
5,239,150 A 8/1993 Bolongeat-Mobleu et al.
5,260,533 A 11/1993 Livesey et al.
5,262,744 A 11/1993 Arnold et al.
5,280,144 A 1/1994 Bolongeat-Mobleu et al.
5,281,776 A 1/1994 Morel et al.
5,296,660 A 3/1994 Morel et al.
5,296,664 A 3/1994 Crookston et al.
5,298,874 A 3/1994 Morel et al.
5,300,907 A 4/1994 Nereau et al.
5,310,971 A 5/1994 Vial et al.
5,313,180 A 5/1994 Vial et al.
5,317,471 A 5/1994 Izoard et al.
5,331,500 A 7/1994 Corcoles et al.
5,334,808 A 8/1994 Bur et al.
5,341,191 A 8/1994 Crookston et al.
5,347,096 A 9/1994 Bolongeat-Mobleu et al.
5,347,097 A 9/1994 Bolongeat-Mobleu et al.
5,350,892 A 9/1994 Rozier
5,357,066 A 10/1994 Morel et al.
5,357,068 A 10/1994 Rozier
5,357,394 A 10/1994 Piney
5,361,052 A 11/1994 Ferullo et al.
5,373,130 A 12/1994 Barrault et al.
5,379,013 A 1/1995 Coudert
5,414,395 A * 5/1995 Garnto et al. ..... 335/18
5,424,701 A 6/1995 Castonguary et al.
5,438,176 A 8/1995 Bonnardel et al.
5,440,088 A 8/1995 Coudert et al.
5,449,871 A 9/1995 Batteux et al.
5,450,048 A 9/1995 Leger et al.
5,451,729 A 9/1995 Onderka et al.
5,457,295 A 10/1995 Tanibe et al.
5,467,069 A 11/1995 Payet-Burin et al.
5,469,121 A 11/1995 Payet-Burin
5,475,558 A 12/1995 Barjonnet et al.
5,477,016 A 12/1995 Baginski et al.
5,479,143 A 12/1995 Payet-Burin
5,483,212 A 1/1996 Lankuttis et al.
5,485,343 A 1/1996 Santos et al.
D367,265 S 2/1996 Yamagata et al.
5,493,083 A 2/1996 Olivier
5,504,284 A 4/1996 Lazareth et al.
5,504,290 A 4/1996 Baginski et al.
5,510,761 A 4/1996 Boder et al.
5,512,720 A 4/1996 Coudert et al.
5,515,018 A 5/1996 DiMarco et al.

| | | | |
|---|---|---|---|
| 5,519,561 | A | 5/1996 | Mrenna et al. |
| 5,534,674 | A | 7/1996 | Steffens |
| 5,534,832 | A | 7/1996 | Duchemin et al. |
| 5,534,835 | A | 7/1996 | McColloch et al. |
| 5,534,840 | A | 7/1996 | Cuingnet |
| 5,539,168 | A | 7/1996 | Linzenich |
| 5,543,595 | A | 8/1996 | Mader et al. |
| 5,552,755 | A | 9/1996 | Fello et al. |
| 5,581,219 | A | 12/1996 | Nozawa et al. |
| 5,604,656 | A | 2/1997 | Derrick et al. |
| 5,608,367 | A | 3/1997 | Zoller et al. |
| 5,726,846 | A | 3/1998 | Houbre |
| 5,784,233 | A | 7/1998 | Bastard et al. |

FOREIGN PATENT DOCUMENTS

| | | |
|---|---|---|
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0477936 | 9/1991 |
| EP | 0 452 230 | 10/1991 |
| EP | 0 555 158 | 8/1993 |
| EP | 0 560 697 | 9/1993 |
| EP | 0580473 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 140 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 228575 | 2/1925 |
| GB | 387023 | 8/1931 |
| GB | 2 233 155 | 1/1991 |
| JP | 58216412 | 12/1983 |
| WO | 92/00598 | 1/1992 |
| WO | 92/05649 | 4/1992 |
| WO | 94/00901 | 1/1994 |

* cited by examiner

CIRCUIT BREAKER COMPRISING A CURRENT TRANSFORMER WITH A PARTIAL AIR GAP

BACKGROUND OF THE INVENTION

The present invention relates to current transformers and, more specifically, to current transformers for use in circuit breakers.

Conventional circuit breaker devices with electronic trip units typically include a current transformer disposed around a line conductor of a distribution system providing electrical power to a load. The current transformer has a multi-turn secondary winding electrically connected to the circuit breaker's electronic trip unit. The secondary winding is used to sense a current overload or imbalance in the aforesaid line conductors and, in response thereto, provide an output signal proportional to the current overload or imbalance to the trip unit. Upon receipt of such a signal the trip unit initiates an interruption of the current supplied to the load through the line conductors. The secondary winding may also be used to provide operating power to the electronic components within the circuit breaker's electronic trip unit.

Operationally, the load current in a circuit breaker can cover a very wide range. Unfortunately, the magnetic materials commonly available for the core of the current transformer limit the dynamic range of the sensing device. Peak flux density is a limiting factor at the upper end of the dynamic range, while core loss/declining permeability is a limit at the lower end. For a given core material and required accuracy, these parameters limit the operating range of the current transformer. While the dynamic range could be extended by increasing the volume of the core material and/or the turns of a secondary winding, these solutions increase the size of the current transformer, which is often critical.

Often, a toroidal current transformer having a core in the shape of a toroid is utilized. A continuous, toroidal core provides a desirable, full dynamic range. However, the use of this type of core in a current transformer for use with a trip unit is not ideal. A trip unit is required to power-up and trip on the first half cycle. Therefore, it is necessary for the current output by the current transformer to have a uniform-sized first half cycle. In other words, it is necessary to employ a current transformer that outputs current with minimal attenuation. While a current transformer having a continuous, toroidal core would provide the desirable, full dynamic range of operating currents, such a current transformer would also provide an undesirable and significant remanence attenuation. Remanence is the flux density that remains in the core after the magnetizing force has ceased. Because of the significant remanence attenuation associated with a continuous, toroidal core, the use of a current transformer having such a core is less than ideal.

To reduce the level of remanence, an air gap can be added to the magnetic core by removing a section of the magnetic core, thus creating a "C" shaped core. When this is done, however, the air gap decreases the level at which saturation of the core takes place and thus reduces the range of current in which the current transformer can operate.

Another commonly used current transformer has a core made of stacked laminations. To prevent the core from becoming saturated at higher current levels, expensive magnetic steel laminates are used. These laminates are sized to allow short-circuit current sensing without causing the core to saturate. A current transformer having a stacked, laminated core transmits very little remanence attenuation, but their use is not ideal because they have a limited range of operation.

BRIEF SUMMARY OF THE INVENTION

In an exemplary embodiment of the invention, a current transformer used to sense electrical current and provide operating power to an electronic trip unit includes a metal core having a top surface and a bottom surface, where the difference between the top and bottom surfaces defines a height of the core. The core has a concentric opening extending through the height so that the planar distance between an outside point on the concentric opening and the closest outside point of the core defines a thickness of the core at that point. A primary winding passes through the opening. A secondary winding also extends through the opening and encircles the thickness of the core. A partial air gap is located in the metal core.

This construction has a number of advantages over the prior art. The use of the air gap reduces the attenuation while still maintaining a maximum operating range. The size of the partial air gap can be pre-determined to optimize the current transformer functionality by minimizing the remanence attenuation while at the same time maximizing the current operating range.

BRIEF DESCRIPTION OF THE DRAWINGS

Referring now to the drawings wherein like elements are numbered alike in the several Figures.

DESCRIPTION OF THE PREFERRED EMBODIMENT

Figure 1:
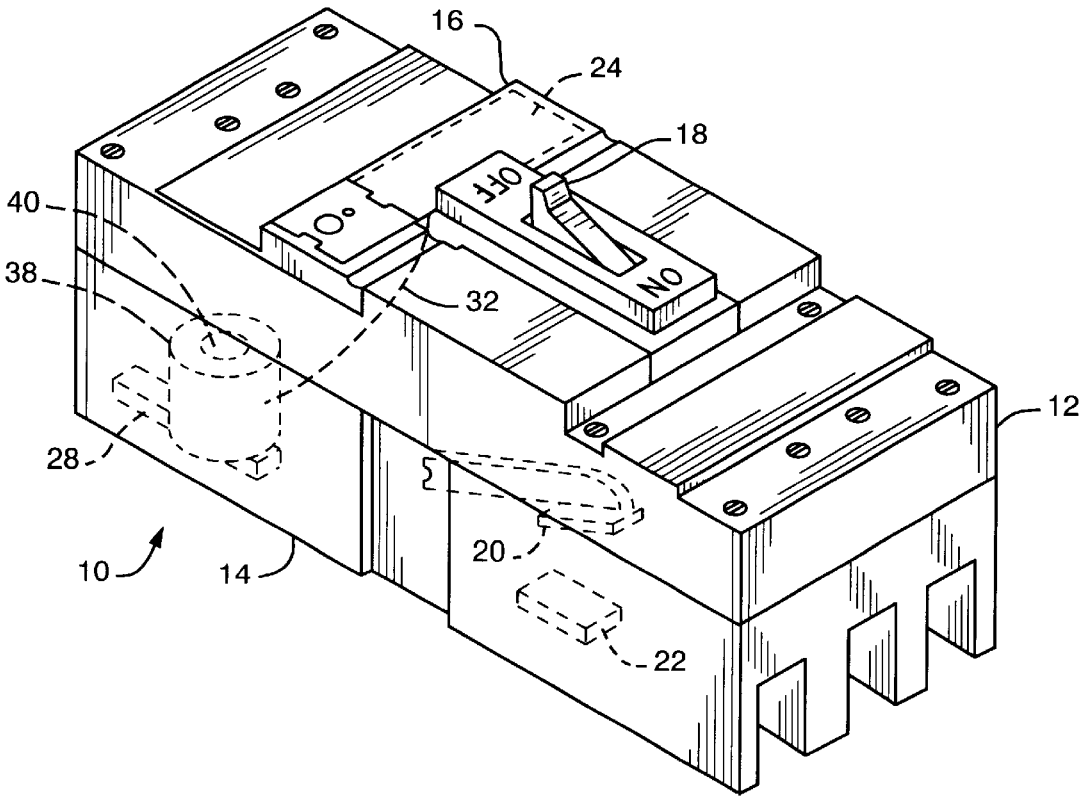
FIG. 1 is a top perspective view of a circuit breaker comprising a partially gapped toroid core current transformer of the present invention.

A circuit breaker 10 of the type consisting of a molded plastic cover 12 secured to a molded plastic case 14 is shown in FIG. 1. The circuit breaker 10 also comprises an accessory cover 16 and an externally-accessible operating handle 18 which manually controls the open and closed condition of a moveable contact 20 in relation to a fixed contact 22 via a circuit breaker operating mechanism (not shown). When opened, the contacts 20, 22 interrupt the current flow through an electronic trip unit 24 located within the circuit breaker cover 12.

Electrical current within the distribution circuit is sampled by a current transformer 38 arranged around a load strap 28 that forms a connection with an external electrical distribution circuit (not shown). An electronic trip unit 24, mounted beneath accessory cover 16, is arranged to receive the sampled current from the current transformer 38. When the sampled current indicates an overcurrent condition in the electrical distribution circuit, electronic trip unit 24 provides a trip signal to an electromechanical actuator (not shown). In response to the trip signal, the electromechanical actuator unlatches the circuit breaker operating mechanism. Once unlatched, the operating mechanism opens contacts 20 and 22, thus interrupting current flow through the electrical distribution circuit and protecting the distribution circuit from damage due to the overcurrent condition. Operation of the circuit breaker 10 is known in the art.

For ease of illustration, FIG. 1 shows one current transformer 38, however it is to be appreciated that in a multiphase electrical distribution system there is one current transformer for each phase. The current transformer 38 provides both operating power as well as current sampling to the electronic trip unit 24.

Figure 2:
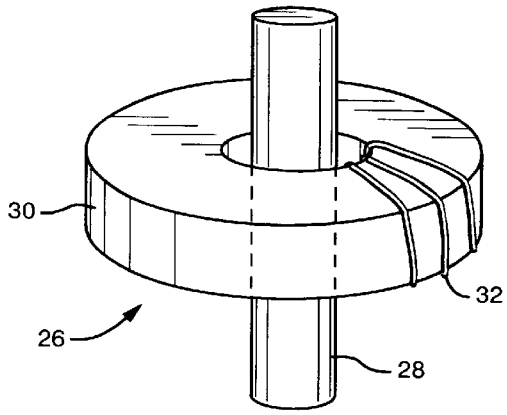
FIG. 2 (PRIOR ART)
FIG. 2 is a perspective view of a toroid core current transformer of the prior art.

FIG. 2 shows a current transformer 26 of the prior art. Conventionally, when a current transformer is needed to measure a load current having a very wide dynamic range, often a transformer 26 having a toroid core 30, as shown in FIG. 2, is utilized. The toroidal core 30 of the current transformer 26 is conventionally formed of tape wound magnetic steel. Desirable materials for transformer cores are those that have a high flux density and keep the temperature rise within desirable limits. Once the core is properly wound it is typically spot welded and coated with a finishing material to hold it together.

Referring to Prior Art FIG. 2, the core 30 of the current transformer 26 surrounds the load strap 28, which also serves as a primary winding, and encircling the core 30 is a secondary winding 32. The current transformer 26 having a core 30 being in the shape of a toroid is capable of operation when the load current covers a very wide dynamic range, however, the effects of remanence attenuation will be significant.

Figure 3:
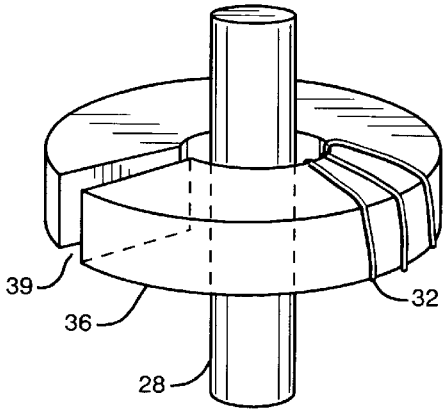
FIG. 3 (PRIOR ART)
FIG. 3 is a perspective view of a toroid core current transformer of the prior art.

In an attempt to reduce the remanence attenuation, an air gap 34 as shown in Prior Art FIG. 3 is often added to the core 30 to form a gapped core 36. The material used to construct the core 30 has a Hysteresis or B-H loop which defines the flux density of the material, the coercive force, the amount of drive level required to saturate the core and the permeability. By adding an air gap 34 to the core 30 the B-H loop is sheared thereby lowering the flux and allowing tighter control of the remanence. Adding an air gap 32 helps to reduce the amount of remanence attenuation however, the air gap 32 decreases the level at which saturation of the gapped core 36 takes place thereby reducing the range in which the current transformer 26 can operate.

Figure 4:
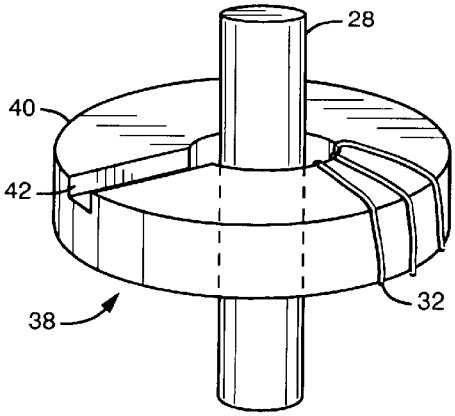
FIG. 4 is a perspective view of a partially gapped toroid core current transformer of the present invention.

Referring to FIG. 4, a current transformer 38 of the present invention includes the load strap or primary winding 28 encircled by a partial gapped core 40 which is formed by adding a partial gap 42 in the core 30. Surrounding the partial gapped core 40 is the secondary winding 32. As in the prior art, the toroidal core 40 of the present invention is conventionally formed of tape wound magnetic steel, with desirable materials for transformer cores including those materials that have a high flux density and keep the temperature rise within desirable limits. Once the core 40 is properly wound, it is spot welded and coated with a finishing material.

Figure 5:
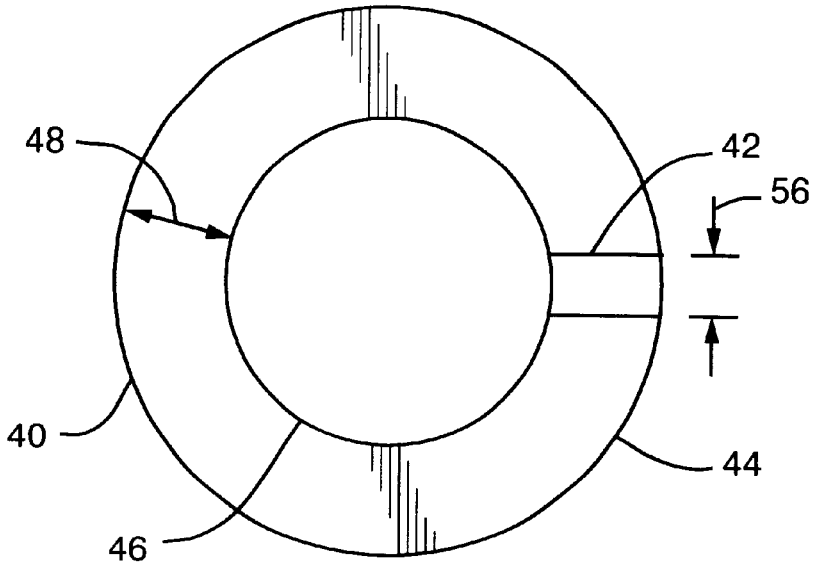
FIG. 5 is a top view of the partially gapped toroid core of FIG. 4.
Figure 6:
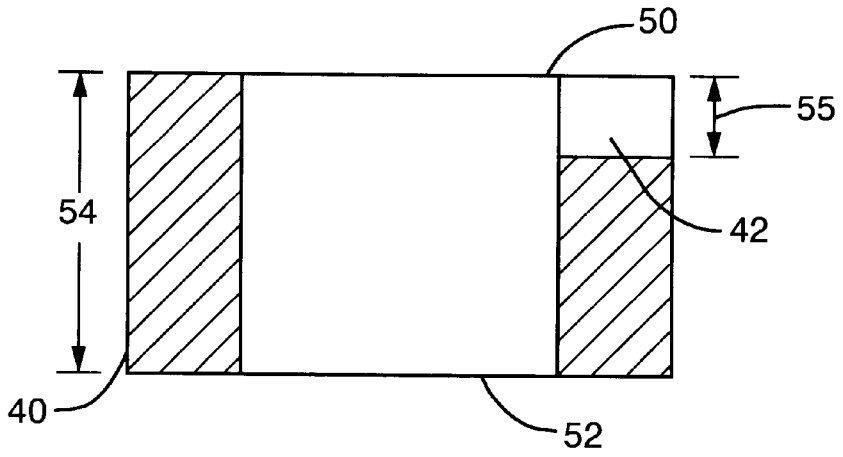
FIG. 6 is a sectional view of the partially gapped toroid core taken along line 6—6 of FIG. 5.

Referring to FIGS. 5 and 6, the partially gapped core 40 comprises an outside diameter 44 and an inside diameter 46 where ½ the difference between the outside diameter 44 and the inside diameter 46 defines a partially gapped core 40 thickness 48. Additionally, the partially gapped core 40 comprises the top surface 50 and a bottom surface 52 where the difference between the two defines a height 54 of the partially gapped core 40. A width 56 of the partial air gap 42 is defined as the opening in the thickness 48 of the core 40.

The size of the partial air gap 42 would vary depending on the desired optimization of the current transformer 38. If the primary consideration of the current transformer is the range in which it can operate, then a smaller partial air gap 42 might be used. However, if reducing the remanence attenuation is the major consideration, a larger partial air gap 42 might be utilized. In the embodiment shown, the partial air gap 42 extends through the entire thickness 48 of the core 40 and has a width 56 of approximately 0.010 inch and a height 55 of approximately ¾ of the height 54. Preferably, width 56 is in the range of 0.010 to 0.020 inches and height 55 is between ⅓ to ¾ of the height 54. Width 56 and height 55 can be varied depending on the desired application of the current transformer 38.

FIGS. 4–6 depict the partial gapped core 40 as a toroid type core with the partial air gap 42 oriented in on a top surface 50 of the partially gapped core 40. It is to be appreciated that other core types can be utilized and the partial air gap 42 can be oriented differently on the partially gapped core 40, some examples of possible orientation of the partial air gap 42 are shown in FIGS. 7–11.

Figure 7:
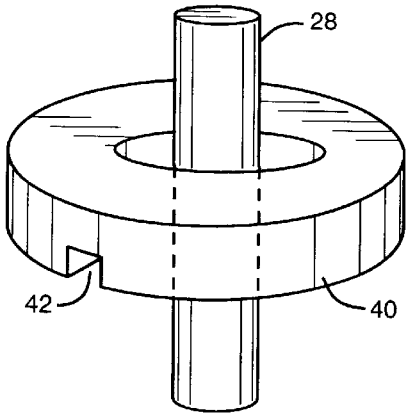
FIG. 7 is a perspective view of a first alternative embodiment of a partially gapped toroid core of present invention.
Figure 8:
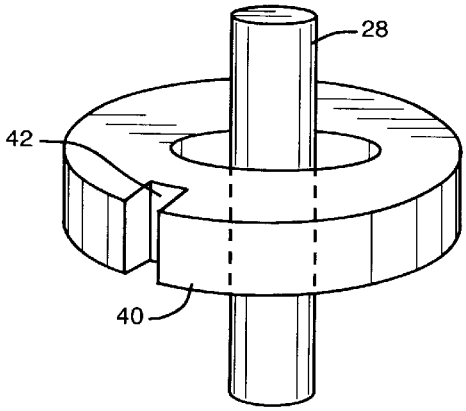
FIG. 8 is a perspective view of a second alternative embodiment of a partially gapped toroid core of present invention.
Figure 9:
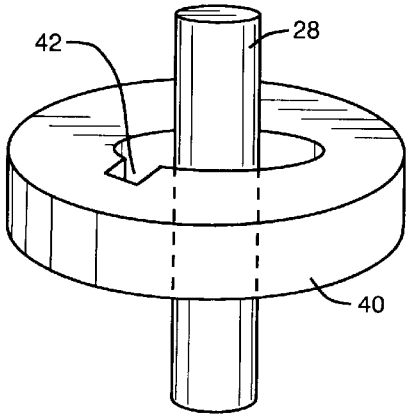
FIG. 9 is a perspective view of a third alternative embodiment of a partially gapped toroid core of present invention.
Figure 10:
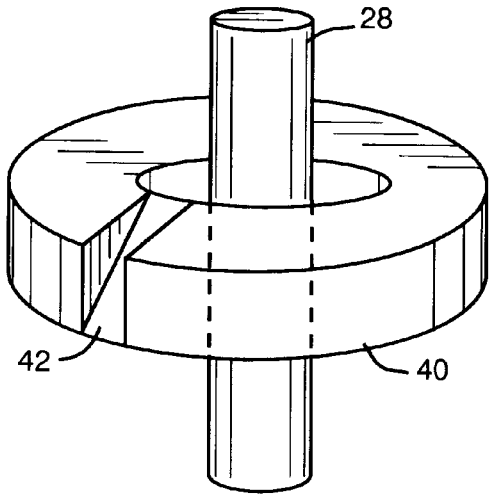
FIG. 10 is a perspective view of a fourth alternative embodiment of a partially gapped toroid core of present invention.
Figure 11:
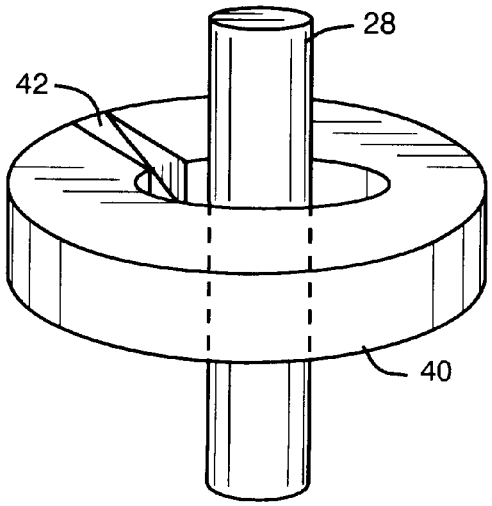
FIG. 11 is a perspective view of a fifth alternative embodiment of a partially gapped toroid core of present invention.

FIG. 7 shows the partial air gap 42 oriented on the bottom surface 52 of the partially gapped core 40 extending through the entire thickness 48 of the core 40 and partially through the height 54 of the core 40. FIG. 8 shows the partial air gap 42 oriented on the outside diameter 44 of the core 40 extending through the entire height 54 of the core 40 and partially through the thickness 48 of the core 40. FIG. 9 shows the partial air gap 42 oriented on the inside diameter 46 of the core 40 extending through the entire height 54 of the core 40 and partially through the thickness 48 of the core 40. FIG. 10 shows the partial air gap 42 angled through the core 40 originating at a point on the inside diameter of the top surface and terminating at a point on the outside diameter of the bottom surface. Finally, FIG. 11 shows the partial air gap 42 angles through the core 40 originating at a point on the outside diameter of the top surface and terminating at a point on the inside diameter of the bottom surface.

By utilizing a partial gapped core 40 the current transformer 38 optimizes both the operational dynamic range of the load current and the remanence attenuation. That is the operational dynamic range of the load current is maximized while at the same time minimizing the amount of remanence attenuation. The partial air gap 42 keeps a portion of the core 40 from magnetizing thereby minimizing the effects of remanence. The range is a function of the cross section area, a complete air gap 34 as shown in FIG. 3 puts a high magnetic impedance path in the core 36 and causes the current transformer 26 to saturate at a lower level. Wherein a partial air gap 42 puts some impedance in but the impedance is small enough to not cause a significant lowering of the saturation level.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A circuit breaker assembly comprising:

a case;

a fixed contact and a movable contact in the case wherein the moveable contact separates from the fixed contact upon the occurrence of an overcurrent condition detected in a protected electrical circuit;

an electronic trip unit within the case adapted to detect the overcurrent condition in the protected electrical circuit and control the moveable contact; and a current transformer within the case and electrically connected to the electronic trip unit wherein the current transformer comprises:

a metal core having a toroidal shape and having a top surface and a bottom surface where the difference between the top and bottom surfaces defines a height of the core, the core having a concentric opening extending through the height so that the distance between an outside point on the concentric opening and the closest outside point of the core defines a thickness of the core at that point;

a primary winding that passes through the opening;

a secondary winding that extends through the opening at least once; and a partial air gap located in the metal core.

2. The circuit breaker assembly of claim 1 wherein the partial gap comprises a predetermined width extending through the thickness of the core and partially through the height of the core.

3. The circuit breaker assemble of claim 1 wherein the partial air gap has a width of 0.010 inches and a height that is approximately ¾ of the height of the core.

4. The circuit breaker assembly of claim 1 wherein the partial air gap has a width in the range of 0.010 to 0.020 inches and a height in the range of ⅓ to ¾ of the height of the core.

5. The circuit breaker assembly of claim 1 wherein the partial air gap comprises a predetermined width extending through the height of the core and partially through the thickness of the core.

6. The circuit breaker assembly of claim 1 wherein the partial air gap is angled to extend partially through the thickness and partially through the height of the core.

7. The circuit breaker assembly of claim 1 further comprises a load strap that connects with an external electrical distribution circuit, wherein the load strap functions as the primary winding.

* * * * *